US006255575B1

(12) United States Patent
Pearse

(10) Patent No.: US 6,255,575 B1
(45) Date of Patent: Jul. 3, 2001

(54) STRING WINDING AND TRIMMING DEVICE

(76) Inventor: John Pearse, Highgrove House, 4787 Rte. 100, New Tripoli, PA (US) 18066

( * ) Notice: Subject to any disclaimer, the term of this patent is extended or adjusted under 35 U.S.C. 154(b) by 0 days.

(21) Appl. No.: 09/547,212

(22) Filed: Apr. 11, 2000

(51) Int. Cl.[7] ..... G10G 7/00

(52) U.S. Cl. ..... 84/458; 84/453; 84/454; 84/312 R

(58) Field of Search ..... 84/454, 458, 453, 84/455, 312 R, 297 S; 30/194, 244, 253

(56) References Cited

U.S. PATENT DOCUMENTS

| | | | | |
|---|---|---|---|---|
| D. 412,011 | * | 7/1999 | Rice et al. | D17/20 |
| D. 421,882 | * | 3/2000 | Mattei | D8/29 |
| 2,812,682 | * | 11/1957 | Longone et al. | 84/458 |
| 3,706,254 | * | 12/1972 | Morin | 84/458 |
| 3,716,879 | * | 2/1973 | Boyajian | 30/194 |
| 4,278,002 | * | 7/1981 | Siminoff | 84/304 |
| 5,272,953 | * | 12/1993 | Koch | 84/458 |
| 5,410,939 | * | 5/1995 | Matamoros et al. | 84/458 |
| 5,505,116 | * | 4/1996 | Pantoja | 84/458 |

OTHER PUBLICATIONS

Sample of a crank–type string winder.

* cited by examiner

*Primary Examiner*—Shih-Yung Hsieh
(74) *Attorney, Agent, or Firm*—Synnestvedt & Lechner LLP

(57) ABSTRACT

A device for winding and trimming the strings of a musical instrument is disclosed, the device having an elongated head with an open receptacle on one side and at one end for interengaging the tuning buttons of the instrument. The other end of the head is rotatably attached to an elongated handle which is offset from the long axis of the head on the side opposite to the open receptacle. To wind a string, the receptacle is interengaged with a tuning button on the instrument, and the handle is moved back and forth in a circular path causing the head to turn and rotate the tuning button. A shear is mounted on the end of the handle for trimming the strings. The shear is formed from two relatively moveable blade portions defining planar surfaces which meet in a common plane. Shearing edges, formed by apertures through each blade portion, traverse the common plane upon relative movement of the blade portions to shear a string extending through the plane between the shearing edges.

17 Claims, 5 Drawing Sheets

14
12
102
18
20
16
10
30
24
32
36
40
26
28
42
38
34
94
96
4
98
22
76
72
70
68
60
58
64
62
66
46
52
44
50
48
56
54
4

FIG. 3
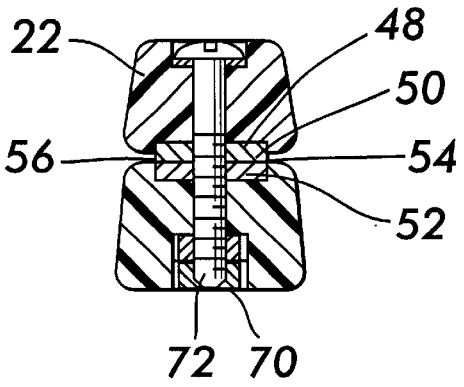
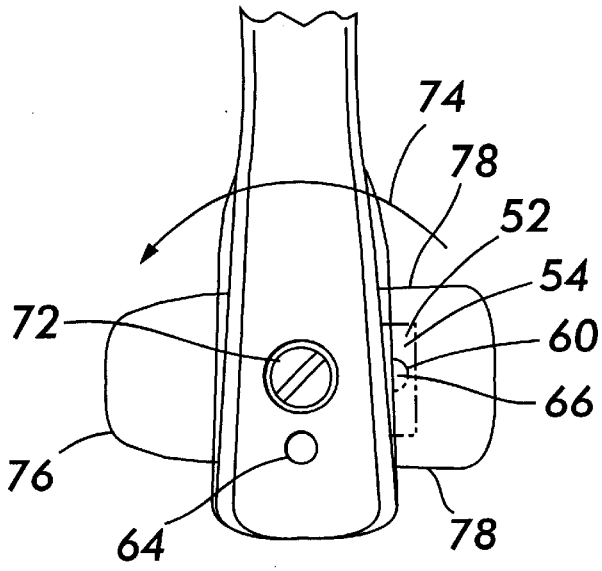
FIG. 4
FIG. 7
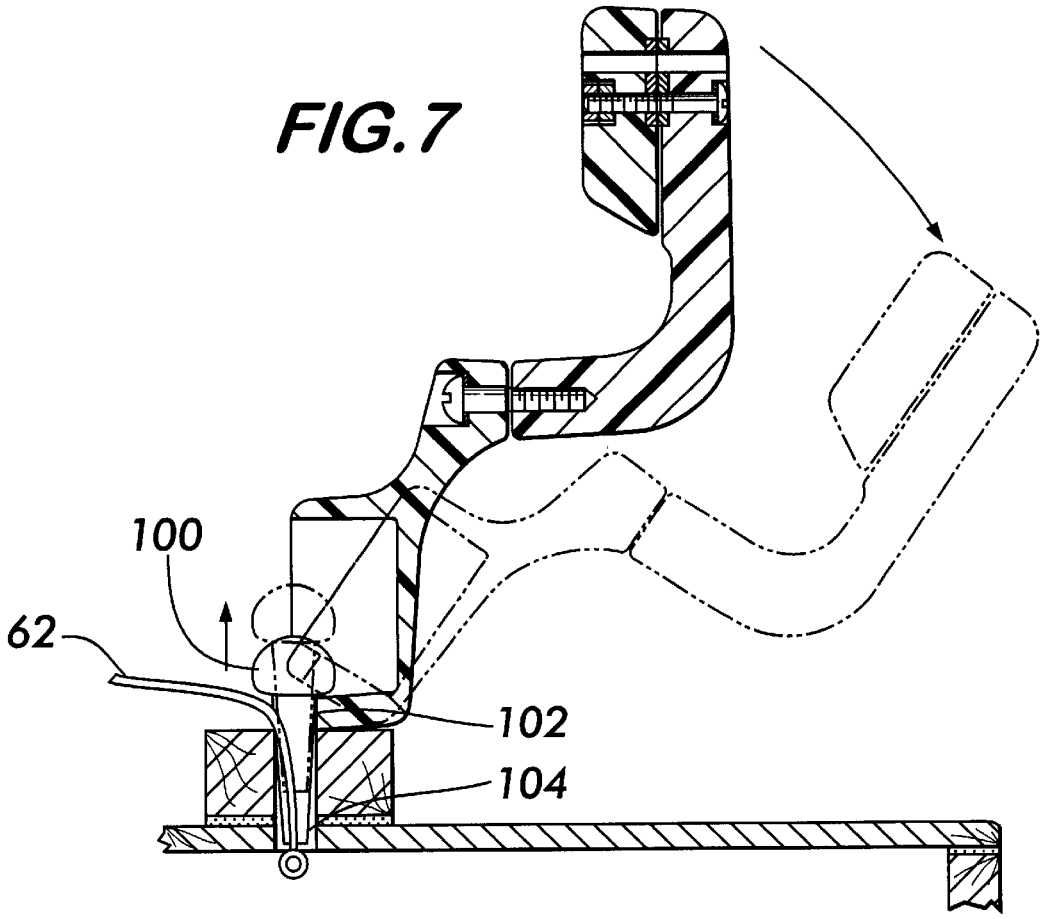

84
106
16
82
10
12
34
32
22
90
108
94
98
86
88
62
80
7
100
7

STRING WINDING AND TRIMMING DEVICE

FIELD OF THE INVENTION

This invention relates to devices used to change the strings on stringed musical instruments, and especially to devices for manually winding the tuning buttons of the instruments to release or apply tension to the strings and thereafter trim any excess length of string.

BACKGROUND OF THE INVENTION

Each string of a stringed musical instrument, such as a guitar, mandolin, violin, viola or cello, is attached at one end to the body of the instrument and extends under significant tension over a bridge, across the body, along an elongated neck and terminates at a headstock located at the end of the neck.

At the headstock, the other end of each string is wound around a respective capstan rotatably mounted on the headstock. The tension of each string, which determines its pitch of vibration, is individually adjustable by rotating the appropriate respective capstan.

In an arrangement often used on guitars and mandolins, the capstan is mounted with its rotational axis oriented perpendicularly to the plane of the headstock. A gear is coaxially mounted on the capstan. The gear engages a worm gear mounted on a shaft having an axis of rotation oriented perpendicularly to the axis of the capstan. The shaft extends outwardly from the headstock and has a tuning button affixed to its end, the tuning button providing purchase to manually turn the shaft. When the shaft is turned, the worm gear turns the gear on the capstan, thereby turning the capstan and adjusting the tension of the particular string attached to it.

The gear ratio between the worm gear and the capstan gear is typically on the order of 16 to 1, meaning that the shaft must be rotated through 16 complete revolutions to effect one full revolution of the capstan. This gear ratio is advantageous when fine tuning a string to a precise pitch because it allows small adjustments in string tension to be made with relatively large rotations of the shaft. However, the gear ratio presents a distinct disadvantage when changing a string on the instrument because the winding button must be turned many times to release the tension of the old string and then apply the required initial tension to the new string before it can be fine tuned to the precise pitch desired.

When changing a string, musicians often use a simple crank device to help them turn the winding button to release the tension of the old string and apply the initial tension to the new string. The crank has a cup at one end which engages the tuning button and a handle extending perpendicularly to the cup and offset from its center. The handle is held between the fingers and thumb of the hand and rotated rapidly by wrist action to turn the winding button and release the tension on the old string or apply the initial tension to the new string. Once the tension of the new string is near the desired value, the crank is disengaged and the tuning button is turned manually to achieve the desired pitch.

There are two problems with the simple crank device. First, the cup tends to wobble as it is turned, bringing the outside edges of the cup in grazing contact with the headstock of the instrument, often leaving unsightly score marks which can adversely affect the resale value of the instrument.

Second, operation of the crank is tiring and stressful to the wrist of the user and can lead to repeated motion injury such as carpal tunnel syndrome or the formation of ganglionic cysts.

Both of these problems are related to the fact that the simple crank is turned using the wrist and the relatively small muscles which control its flexing. The turning motion generated by circularly flexing the wrist joint does not orbit about a single true axis but precesses in a cone of revolution about a central axis. This can be observed by holding a pencil between the index finger and thumb and rotating the pencil in a circle by means of wrist motion alone. The tip of the pencil describes a cone. In the simple crank, the cup is eccentrically mounted at the end of the crank handle, and when the handle is turned by the wrist, the cup naturally wobbles toward and away from the headstock as it traverses the conical path described by the end of the handle.

The natural wobble is exaggerated as the wrist muscles grow tired. These muscles tend to fatigue quickly which leads to a loss of control of the simple crank. For many musicians, the wrist muscles cannot keep adequate control of the crank for the number of turns required to tension the string and the wobble of the cup increases.

Finally, it is well known that the wrist is a complex joint through which nerve ganglia, tendons and blood vessels must pass while allowing the full range of motion to the hand. The complexity makes the wrist especially vulnerable to repeated motion trauma and not ideally suited to operate a crank.

Changing a string also typically requires that the string be trimmed to length. When a new string is mounted on an instrument and tuned to the desired pitch, there is often a relatively long extraneous piece of the string protruding from the capstan. It is preferable to cut this protruding piece so that it will not rattle and produce noise when the instrument is played. The practice has been to cut the string with a pair of wire snips. There are several disadvantages to this solution however. The blades of the wire snips tend to leave a hook-like deformation on the string end which tends to snare clothing and will also inflict painful injury to the skin of a person coming in contact with the end. Furthermore, wire snips tend to have exposed steel parts which will damage the instrument if they come into contact with it, as, for example, when the wire snips are stored in the instrument's case and become loose when the case is in transit.

There is clearly a need for a better device useable by musicians to perform the tasks, such as string winding and trimming, associated with changing the strings of instruments such as guitars and the like, which does not suffer from the disadvantages outlined above.

SUMMARY AND OBJECTS OF THE INVENTION

The invention comprises a device for manually turning a tuning button of a stringed musical instrument for changing the tension of a string. In its preferred embodiment, the device has an elongated head with an open receptacle positioned at one end and on one side of the head for receiving the tuning button. An elongated handle is pivotally attached for rotational movement of the head, thereby turning the tuning button received within the open receptacle. The handle is positioned on the side of the head opposite to the side having the open receptacle and extends lengthwise along an axis laterally offset from a first axis of the head. Means for pivotally connecting one end of the handle to the other end of the head are provided, there being a pivot axis extending transversely, and preferably substantially perpendicularly to the first axis of the head.

The pivotal connecting means preferably comprises an elongated linking portion extending between the one end of the handle and the other end of the head. The long axis of the linking portion is arranged transversely, and preferably substantially perpendicularly to the axes of the handle and the head. A rotating joint is mounted on the linking portion, the joint having an axis of rotation oriented transversely and preferably perpendicularly to the axes of both the handle and the head.

Preferably, the open receptacle has a rectangular cross-section adapted to receive the tuning button and impart the torque necessary to turn it to adjust the tension of the string. The receptacle is also capable of receiving a removably interfitting insert which has a second receptacle. The second receptacle preferably has a rectangular cross-section also and is sized relatively smaller than the first named receptacle to adapt the device to accept a plurality of relatively smaller sizes of tuning buttons.

The invention also comprises a shear mounted on the handle for trimming the string. Preferably, the shear comprises a first blade portion mounted on the end of the handle and defining a first planar surface. A second blade portion is mounted for relative movement on the first blade portion, the second blade portion defining a second planar surface. The first and second planar surfaces meet in a common plane and have shearing edges relatively movable in the common plane upon relative movement of the second blade portion. The shearing edges are effective to shear a string passing through the common plane upon relative movement of the second blade portion.

Preferably, the second blade portion is rotatably mounted on the handle portion for relative rotational motion with respect to the first blade portion about an axis oriented perpendicularly to said first and second planar surfaces. The shearing edges are defined by apertures passing through the blade portions and the handle. The apertures are moveable from a position of coaxial alignment with one another to a position out of alignment upon relative movement of the second blade portion to effect shearing of a string passing through said apertures and the common plane.

The preferred method of manually turning a tuning button of a stringed musical instrument using the device according to the invention comprises the steps of interengaging the open receptacle with the tuning button and moving the handle back and forth (with the wrist held rigid) substantially perpendicularly to the pivot axis in a substantially circular path causing the head to rotate and turn the tuning button.

It is an object of the invention to provide a device useful for changing the strings of a stringed musical instrument.

It is another object of the invention to provide a device which can be used to rapidly release or apply tension to a string being changed on an instrument by facilitating the turning of the tuning buttons.

It is still another object of the invention to provide a device which can turn the tuning buttons without danger of injury to the wrist of the musician using the device.

It is yet another object of the invention to provide a device which can turn the tuning buttons without damaging the headstock of the instrument.

It is again another object of the invention to provide a device which can be easily adapted to receive and turn differently sized tuning buttons.

It is yet again another object of the invention to provide a device which can be used to trim the string of extraneous length once it has be tensioned.

It is still again another object of the invention to provide a device which can cleanly trim the string without leaving hook-like deformations on the trimmed end of the string.

These and other objects of the invention will become apparent from a consideration of the following drawings and detailed description of the preferred embodiment of the invention.

BRIEF DESCRIPTION OF THE DRAWINGS

FIG. 3 is a cross-sectional view of the string winding and trimming device taken along line 3—3 of FIG. 1;

FIG. 4 is a side view of a portion of the string winding and trimming device shown in FIG. 1;

FIG. 7 is a partial cross-sectional view taken along line 7—7 in FIG. 5 showing how a string is removed using the string winding and trimming device shown in FIG. 1.

DETAILED DESCRIPTION OF THE PREFERRED EMBODIMENT

Figure 1:
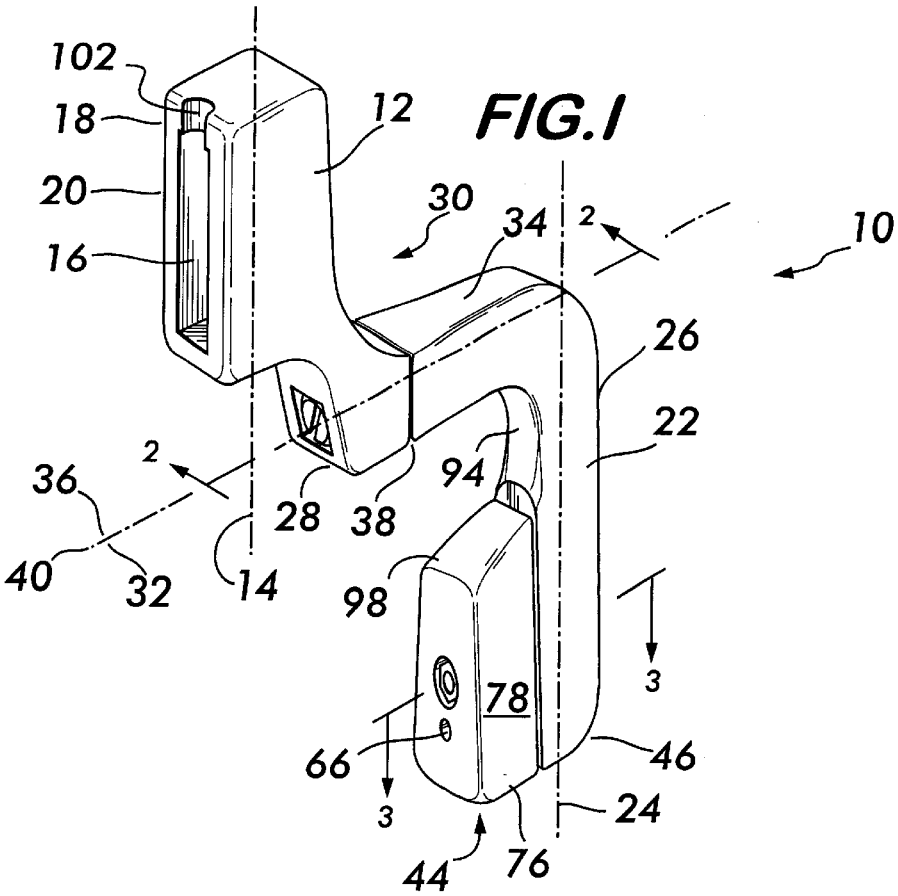
FIG. 1 shows a perspective view of a string winding and trimming device according to the invention.

FIG. 1 shows the string winding and trimming device 10 according to the invention comprising an elongated head 12 having a first or long axis 14. An open receptacle 16 is positioned at one end 18 and on one side 20 of head 12, the receptacle receiving a tuning button of a stringed instrument, described below.

An elongated handle 22 is positioned on the side of head 12 opposite to side 20 and extends along a second or long axis 24 laterally offset from the long axis 14 of the head. An end 26 of handle 22 is pivotally connected to another end 28 of head 12 by a pivotal connecting means 30 having a pivot axis 32 extending transversely to the long axis 14 of head 12. Preferably, pivot axis 32 is substantially perpendicular to the long axis 14, as best seen in FIG. 2.

Pivotal connecting means 30 preferably comprises an elongated linking portion 34 extending between ends 26 and 28 of the handle and the head respectively, the linking portion having a long axis 36 oriented transversely, and preferably perpendicularly to the long axes 14 and 24 of the head and handle respectively. A rotating joint 38 is mounted on the linking portion 34 and has an axis of rotation 40 oriented transversely and preferably perpendicularly to the long axes 14 and 24 of the head and handle respectively.

Figure 2:
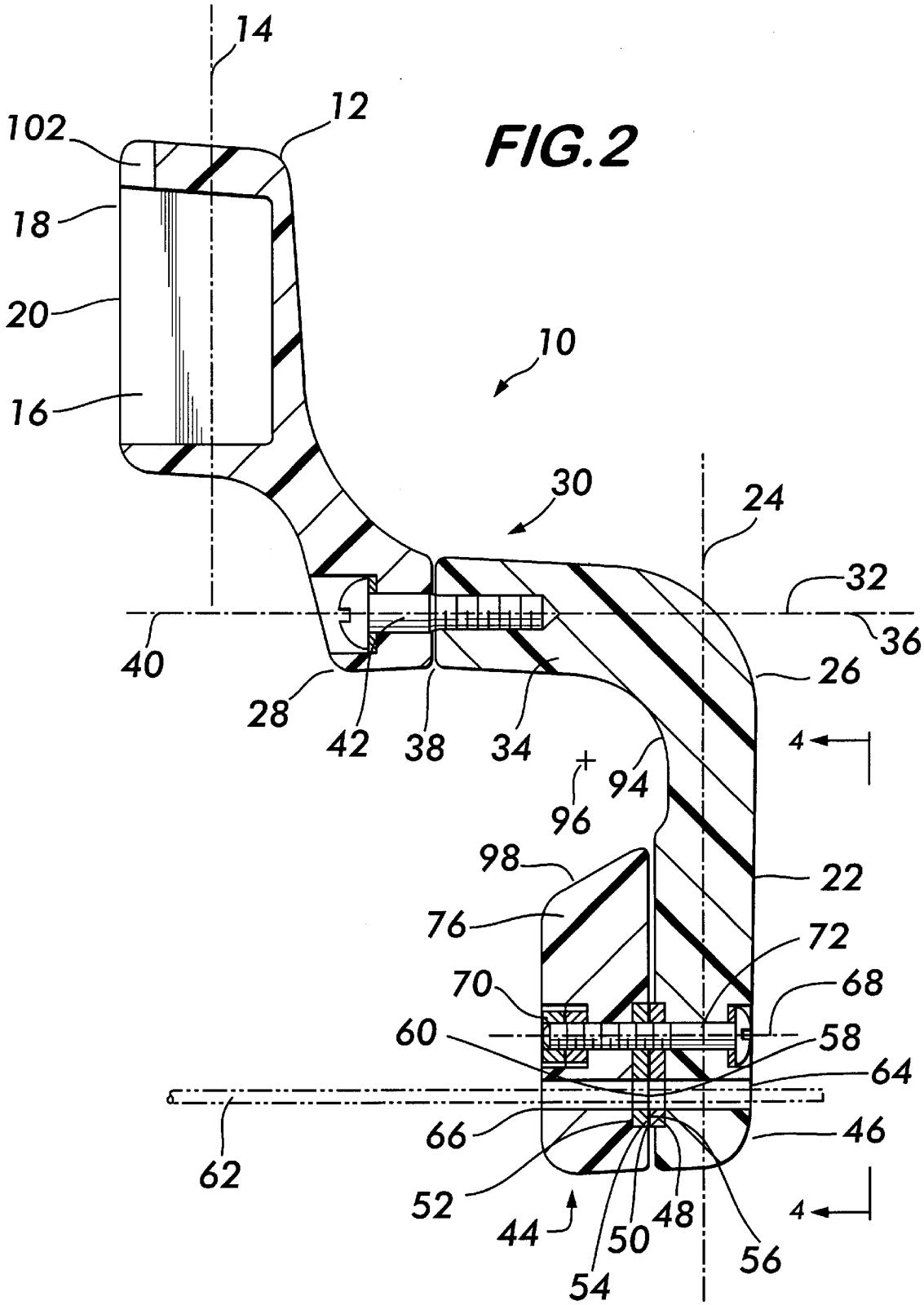
FIG. 2 shows a cross-sectional view of the string winding and trimming device taken along line 2—2 of FIG. 1.

As shown in FIG. 2, rotating joint 38 preferably comprises a fastener such as screw 42 which retains head 12 to handle 22 while allowing each component to rotate about axis 40 relative to one another.

A shear 44 is mounted at another end 46 of handle 22. As best seen in FIGS. 2 and 3, shear 44 comprises a first blade portion 48 mounted on the handle 22. First blade portion 48 defines a first planar surface 50. A second blade portion 52 is mounted for relative movement on the first blade portion as described below. Preferably, the blade portions are made of tool steel to effectively shear strings made of metal wire.

Second blade portion 52 defines a second planar surface 54 which meets with the first planar surface 50 in a common plane 56. As shown in FIG. 2, the first and second blade portions have respective shearing edges 58 and 60 which are relatively movable in the common plane 56 to shear a string 62 (shown in broken line) passing through the common plane.

Preferably, the shearing edges 58 and 60 are defined by apertures 64 and 66 respectively which pass through the blade portions 48 and 52, as well as the handle 22. The apertures preferably have a round cross-section which is easy to form, as by drilling, and best accommodates strings having round cross sections. As shown in FIGS. 2 and 4, second blade portion 52 is preferably rotatably mounted on handle 22 for rotational motion with respect to the first blade portion 48 about an axis 68 oriented perpendicularly to the first and second planar surfaces 50 and 54 respectively. A nut 70 and bolt 72 are used to rotatably mount the second blade portion, it being understood that other fasteners which would allow rotation yet retain the blade portions together would serve equally well.

Second blade portion 52 is rotatably movable about axis 68 from a position where the apertures 64 and 66 are in a position of coaxial alignment with one another, shown in FIG. 2, to a position where the apertures are out of coaxial alignment, as shown in FIG. 4, the direction of relative rotation of the blade portions being indicated by arrow 74. The relative rotational motion of the blade portions moves the shearing edges 58 and 60 in the common plane 56 to effect the shearing of the string 62. Such shearing action is found to cleanly sever the string leaving no hazardous hooked profile on the sheared ends.

To facilitate manual rotation of the blade portions, a finger grip 76 is attached to the second blade portion 52. As best seen in FIGS. 1 and 4, finger grip 76 comprises a pair of oppositely arranged gripping surfaces 78 which project substantially perpendicularly to the second planar surface 54 in a direction away from handle 22. The gripping surfaces 78 are grasped between the index finger and thumb (see FIG. 5 at 108) and allow the second blade portion 52 to be easily rotated relative to the first blade portion 48 to shear the string 62. Finger grip 76, as well as the end 46 of handle 22, are designed to completely cover the blade portions 48 and 52 leaving no exposed edges of hardened tool steel which can damage the surface of the instrument upon contact.

FIGS. 5, 6A–6D and 7 illustrate use of the device 10 according to the invention to change a string 62 on a guitar 80, it being understood that use of the device is not limited to a guitar, which is only chosen by way of example.

Figure 5:
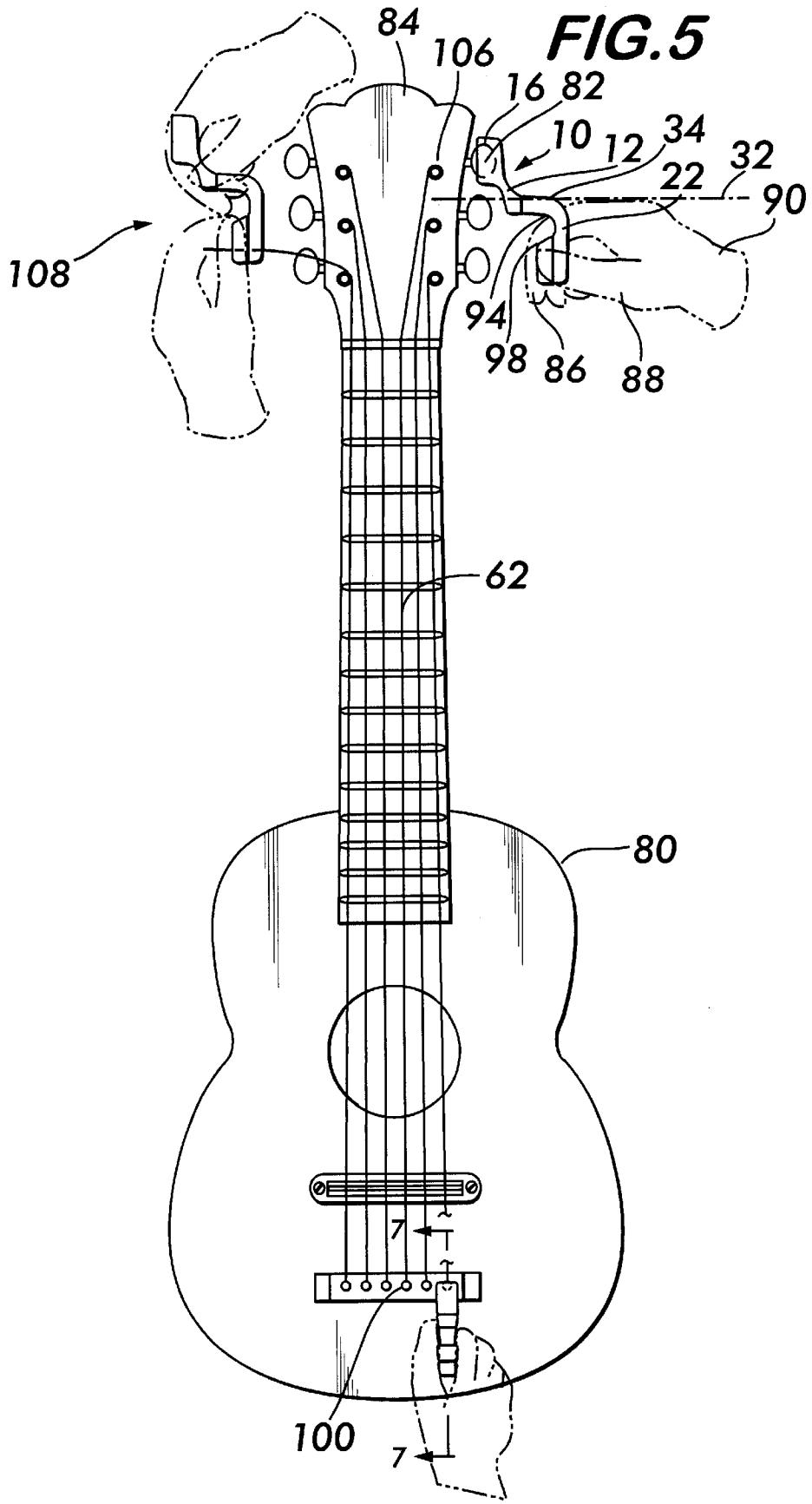
FIG. 5 is a view of a stringed instrument illustrating how the string winding and trimming device shown in FIG. 1 is used to change a string.
Figure 6A:
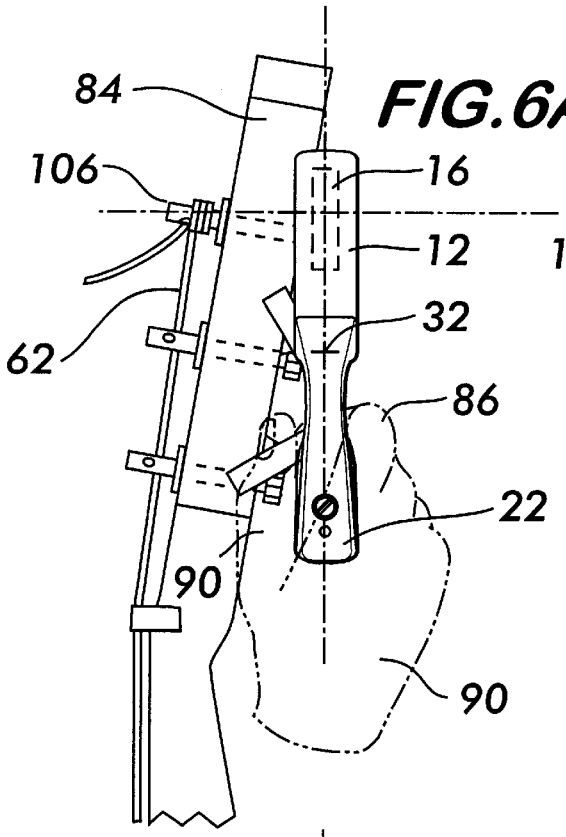
FIGS. 6A through 6D illustrates how the string winding and trimming device shown in FIG. 1 is used to turn the tuning button of a stringed instrument to apply or release tension in the string.
Figure 6B:
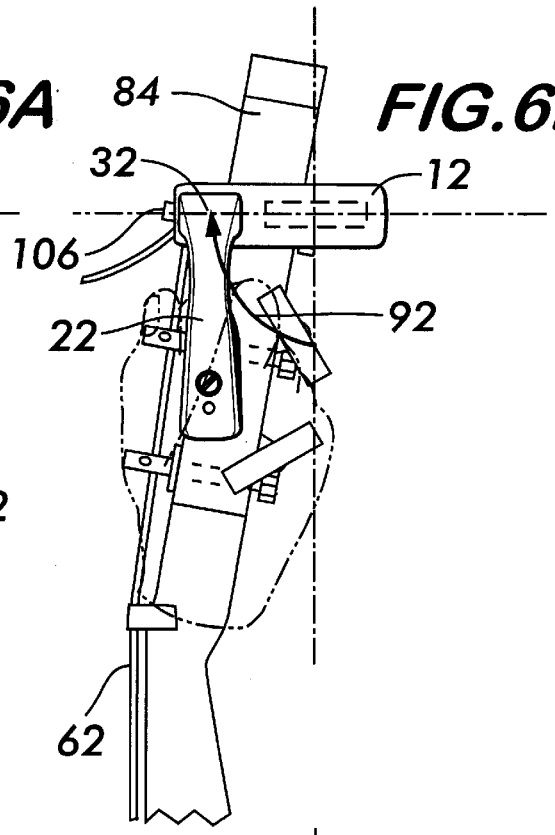
Figure 6C:
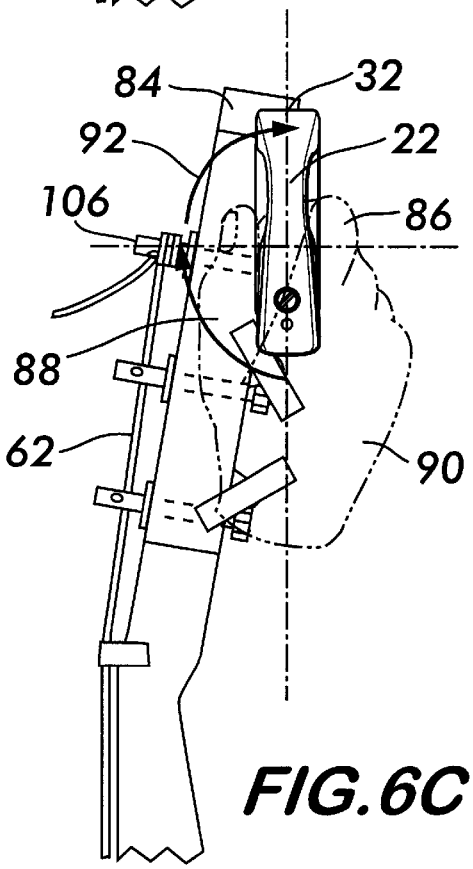
Figure 6D:
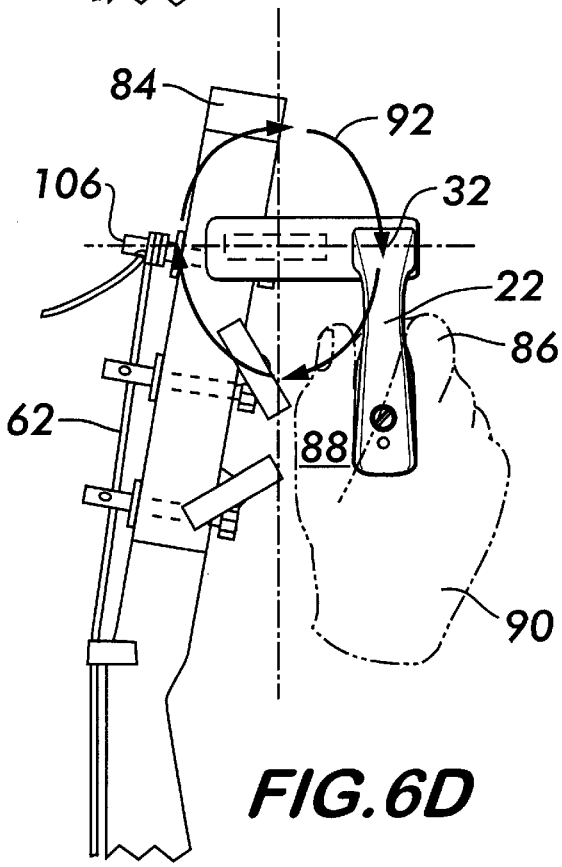

As shown in FIG. 5, open receptacle 16 is interengaged with a tuning button 82 extending from the headstock 84 of guitar 80. The handle 22 is grasped between the index finger 86 and the thumb 88 of hand 90 (see also FIG. 6A) and the handle is moved back and forth substantially perpendicularly to the pivot axis 32 in a substantially circular path 92 (see FIGS. 6B–6D) causing the head 12 to rotate and turn tuning button 82 to release the tension on the string 62. Motion of the handle 22 is preferably effected by arm motion in a piston-like manner with the wrist held rigid, and not by wrist action as with a simple crank. The piston-like motion is more truly circular and substantially eliminates the tendency of the head 12 to wobble and contact the headstock, thus, largely eliminating the potential for damage to the headstock when changing strings. Use of arm motion also prevents injury to the wrist from repeated motion trauma, and the larger arm muscles do not fatigue as quickly, resulting in the ability to sustain controlled turning effort needed to tension the string.

To ensure a good grip for the hand, the linking portion 34 of the handle 22 is provided with a curved surface 94 (best shown in FIG. 2) having a center of curvature 96 located between the long axes 14 and 24 of the head 12 and handle 22 respectively. The curved surface comfortably accommodates the finger 86 when the handle is gripped. To further insure a positive grip of handle 22, a bearing surface 98 is provided. As best seen in FIGS. 1 and 2, bearing surface 98 is positioned adjacent to the curved surface 94 and engages the finger 86 to prevent the handle from slipping from the hand 90.

Once the string tension has been released, the string is removed from the instrument, as shown in FIG. 7, by pulling the bridge pin 100 which attaches the string to the body of the guitar. Device 10 has a semi-cylindrical cutout 102 at the end of head 12 (see FIG. 1) which engages the bridge pin. The head 12 and handle 22 are used as a lever to pry the bridge pin from its socket 104 and release the string.

A new string, also labeled 62, is then mounted on the guitar by engaging one end with the socket 104 and fixing it in place with the bridge pin 100. The other end of the string is engaged with a capstan 106 mounted in the headstock 84. Receptacle 16 is again interengaged with tuning button 82 which turns the capstan 106 through the gear arrangement described in the Background of the Invention section. The device 10 is then used to rapidly turn the tuning button by the method shown in FIGS. 6A–6D to apply the initial tension to the string 62. When the tension in the string is near the tension required to produce the desired pitch, the device 10 is disengaged and the tuning button is adjusted by hand to fine tune the vibrational pitch of the string.

Any excess length of string is trimmed by use of the shear 44, shown at 108 in FIG. 5, for another string. The excess length of string is passed through the apertures 64 and 66 in blade portions 48 and 52 (see FIG. 2) and the gripping surfaces 78 are grasped between index finger 86 and thumb 88 and rotated (see FIG. 4) to move the apertures out of alignment, thereby shearing the string.

Figure 8:
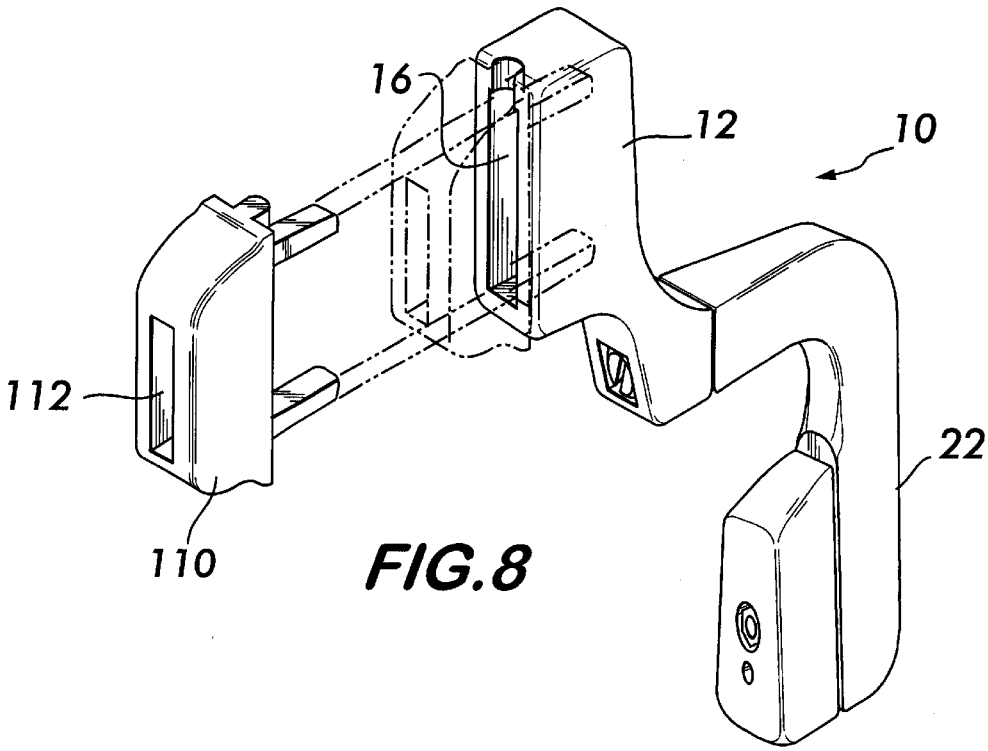
FIG. 8 is a perspective view illustrating the use of an insert to adapt the string winding and trimming device to receive a plurality of different sized tuning buttons.

To allow device 10 to be used with a wide variety of instruments having tuning buttons of different sizes, an insert 110 is provided, as shown in FIG. 8. Insert 110 interfits removably within open receptacle 16 in the head 12 of device 10 and also has an open receptacle 112 for receiving tuning buttons. Receptacle 112 is sized smaller than receptacle 16 to effectively engage smaller sized tuning buttons. Rectangular cross-sections are preferred for the receptacles to ensure positive contact with the tuning buttons for rapid turning without slippage.

Use of the string winding and trimming device according to the invention to change strings of musical instruments avoids the problems typically associated with this task, such as damage to the headstock of the instrument and wrist trauma such as carpal tunnel syndrome and the formation of ganglionic cysts. The device provides one tool, easily carried and used to quickly and safely perform the tedious steps necessary to apply or release tension from the strings and trim excess string length.

What is claimed is:

1. A device for manually turning a tuning button of a stringed musical instrument for changing the tension of a string, said device comprising:

an elongated head having a first axis extending lengthwise therealong, said head having a first open receptacle positioned at one end and on one side of said head for receiving the tuning button;

an elongated handle for rotational movement of the head, thereby turning the tuning button received within the first open receptacle, said handle being positioned on the side of the head opposite to the side having the first open receptacle and extending lengthwise along a second axis laterally offset from said first axis; and means pivotally connecting one end of the handle to an end of the head opposite to said one end through a pivot axis offset from said first open receptacle and extending transversely to said first axis.

2. A device according to claim 1, wherein said pivot axis extends substantially perpendicularly to said first axis.

3. A device according to claim 1, wherein said pivotal connecting means comprises:

an elongated linking portion extending between said one end of said handle and said end of said head opposite to said one end; and a rotating joint mounted on said linking portion having an axis of rotation oriented parallel to said pivot axis.

4. A device according to claim 3, wherein said axis of rotation is oriented substantially perpendicularly to said first and said second axes.

5. A device according to claim 4, wherein said rotating joint is positioned on said linking portion adjacent to said end of said head opposite to said one end.

6. A device according to claim 5 having a curved surface joining said linking portion to said one end of said handles said curved surface having a center of curvature located between said first and said second axes, said curved surface accommodating a finger of a hand gripping said handle.

7. A device according to claim 6, further comprising a bearing surface extending from said handle transversely to said second axis, said bearing surface being positioned adjacent to said curved surface and engaging the finger accommodated by said curved surface to prevent said handle from slipping from the hand gripping said handle.

8. A device according to claim 1, wherein said first open receptacle has a rectangular cross-section.

9. A device according to claim 8, further comprising an insert removably interfitting within said first open receptacle, said insert having a second open receptacle sized relatively smaller than said first open receptacle and adapting said device to accept a plurality of relatively smaller sizes of tuning buttons.

10. A device according to claim 9, wherein said second open receptacle has a rectangular cross-section.

11. A device according to claim 1, further including a shear mounted on said handle for trimming said string, said shear comprising a first blade portion mounted on the other end of said handle and defining a first planar surface, and a second blade portion mounted for relative movement on said first blade portion, said second blade portion defining a second planar surface, said first and said second planar surfaces meeting in a common plane and having shearing edges relatively movable in said common plane upon relative movement of said second blade portion, said shearing edges being effective to shear a string passing through said common plane upon relative movement of said second blade portion.

12. A device according to claim 11, wherein said second blade portion is rotatably mounted on said handle for relative rotational motion with respect to said first blade portion about an axis oriented perpendicularly to said first and second planar surfaces.

13. A device according to claim 12, wherein said shearing edges are defined by apertures passing through said blade portions and said handle, said apertures being moveable from a position of coaxial alignment with one another to a position out of alignment upon relative movement of said second blade portion to effect shearing of said string passing through said apertures and said common plane.

14. A shear according to claim 13, wherein said apertures each have a circular perimeter.

15. A shear according to claim 14, further comprising means for rotatably mounting said second blade portion on said handle, said second blade portion being rotatably movable relative to said first blade portion on said rotatable mounting means to bring said apertures into and out of coaxial alignment.

16. A shear according to claim 15, further comprising a finger grip attached to said second blade portion, said finger grip comprising a pair of oppositely arranged gripping surfaces projecting substantially perpendicularly to said second planar surface in a direction away from said handle, said gripping surfaces providing purchase for manual grasping and rotating of said second blade portion relatively to said first blade portion.

17. A method of manually turning a tuning button of a stringed musical instrument using the device according to claim 1, said method comprising the steps of:

interengaging said first open receptacle with said tuning button; and moving said handle back and forth substantially perpendicularly to said pivot axis in a substantially circular path causing said head to rotate and turn said tuning button.

* * * * *